US007076956B2

(12) United States Patent
Young et al.

(10) Patent No.: US 7,076,956 B2
(45) Date of Patent: Jul. 18, 2006

(54) COMBUSTION CHAMBER FOR GAS TURBINE ENGINE

(75) Inventors: Kenneth James Young, Quebec (CA); Klaus Stefan Steinbach, Bramley (GB); Volker Herzog, Bristol (GB); Iain David Jeffrey Dupere, Cambridge (GB); Alan Philip Geary, Bristol (GB); Miklos Gerendas, Zossen (DE)

(73) Assignees: Rolls-Royce PLC, London (GB); Rolls-Royce Deutschland Ltd. & Co. KG, Dahlewitz (DE)

( * ) Notice: Subject to any disclaimer, the term of this patent is extended or adjusted under 35 U.S.C. 154(b) by 102 days.

(21) Appl. No.: 10/734,129

(22) Filed: Dec. 15, 2003

(65) Prior Publication Data

US 2004/0211185 A1 Oct. 28, 2004

(30) Foreign Application Priority Data

Dec. 23, 2002 (GB) ..... 0229755.4

(51) Int. Cl.
*F02C 7/24* (2006.01)
*F23R 3/50* (2006.01)

(52) U.S. Cl. ..... 60/725

(58) Field of Classification Search ..... 60/725, 60/39.83, 752–760
See application file for complete search history.

(56) References Cited

U.S. PATENT DOCUMENTS

| | | | | |
|---|---|---|---|---|
| 2,807,931 | A * | 10/1957 | Bodine, Jr. | 60/208 |
| 3,982,392 | A * | 9/1976 | Crow | 60/753 |
| 4,216,651 | A * | 8/1980 | Ormerod | 60/740 |
| 4,786,188 | A * | 11/1988 | Myhre et al. | 374/125 |
| 5,285,630 | A * | 2/1994 | Ansart et al. | 60/39.23 |
| 5,373,695 | A * | 12/1994 | Aigner et al. | 60/725 |
| 5,431,008 | A * | 7/1995 | Ross et al. | 60/803 |
| 5,685,157 | A * | 11/1997 | Pandalai et al. | 60/725 |
| 6,354,733 | B1 * | 3/2002 | Glasheen et al. | 374/131 |
| 6,370,879 | B1 * | 4/2002 | Stalder et al. | 60/725 |
| 6,530,221 | B1 * | 3/2003 | Sattinger et al. | 60/725 |

FOREIGN PATENT DOCUMENTS

GB 2288660 A * 10/1995

* cited by examiner

*Primary Examiner*—Ted Kim
(74) *Attorney, Agent, or Firm*—Oliff & Berridge, PLC

(57) ABSTRACT

A combustion chamber suitable for a gas turbine engine is provided with at least one Helmholtz resonator having a resonator cavity and a damping tube in flow communication with the chamber interior. The damping tube is provided with at least one cooling hole extending through its wall for improved damping and cooling.

5 Claims, 3 Drawing Sheets

COMBUSTION CHAMBER FOR GAS TURBINE ENGINE

This invention relates to combustion chambers for gas turbine engines, and in particular concerns lean burn, low emission combustion chambers having one or more resonator chamber for damping pressure fluctuations in the combustion chamber in use.

Lean burn, low emission gas turbine engine combustors of the type now being developed for future engine applications have a tendency, under certain operating conditions, to produce audible pressure fluctuations which can cause premature structural damage to the combustion chamber and other parts of the engine. These pressure fluctuations are audible as rumble which occurs as a result of the combustion process.

Pressure oscillations in gas turbine engine combustors can be damped by using damping devices such as Helmholtz resonators, preferably in flow communication with the interior of the combustion chamber or the gas flow region surrounding the combustion chamber.

The use of Helmholtz resonators has been proposed in a number of earlier published patents including for example U.S. Pat. No. 5,644,918 where a plurality of resonators are connected to the head end, that is to say the upstream end, of the flame tubes of an industrial gas turbine engine combustor. This type of arrangement is particularly suitable for industrial gas turbine engines where there is sufficient space at the head of the combustor to install such damping devices. The combustor in a ground based engine application can be made sufficiently strong to support the resonators and the vibration loads generated by the resonators in use. This arrangement is not practicable for use in aero engine applications where space, particularly in the axial direction of the engine, is more limited and component weight is a significant design consideration.

A different approach to combustion chamber damping is therefore required for aero engine applications where space is more limited and design constraints require that the resonators are supported with respect to the combustion chamber without adding appreciably to the weight of the combustion chamber itself.

According to an aspect of the present invention there is provided a combustion chamber for a gas turbine engine comprising at least one Helmholtz resonator having a resonator cavity and a damping tube in flow communication with the interior of the combustion chamber, the tube having at least one cooling hole extending through the wall thereof.

The above arrangement provides for cooling of the damping tube of a Helmholtz resonator in flow communication with the interior of the combustion chamber. This can prevent overheating of the damping tube particularly in the region towards the end of the tube which opens into the interior of the combustion chamber. The present inventors have also found that the cooling hole or holes provides for improved damping performance of the Helmholtz resonator. It is to be understood that the term "cooling hole" used herein refers to any type of aperture through which cooling air or other fluid can pass.

In preferred embodiments, a plurality of cooling holes are provided in the wall of the tube. In this way it is possible to more uniformally cool the interior surface of the tube, particularly in embodiments where the holes are circumferentially spaced in one or more rows extending around the circumference of the tube. By spacing the cooling holes in this way it is possible to generate a film of cooling air on the interior surface of the tube wall in the region of the combustion chamber opening. This is particularly important since the film can protect the tube from the effects of the high temperature combustion gases entering and exiting the damping tube during unstable combustor operation.

Preferably, the combustion chamber comprises a plurality of axially spaced rows of cooling holes. By having two or more rows of cooling holes greater cooling efficiency can be achieved.

In preferred embodiments, the holes are angled with respect to the longitudinal axis of the tube. This can prevent separation of the cooling air passing through the holes from the interior surface of the tube in the region of the holes. This arrangement also promotes flow of cooling air in the longitudinal direction of the tube.

Preferably, the holes are angled in a direction towards the combustion chamber end of the tube such that the respective axis of the holes converge in the direction of the combustion chamber. In this way the cooling air generates a film of cooling air between the holes and the end of the tube in the region of the combustion chamber opening.

Preferably the angle of the holes with respect to the longitudinal axis is in the region of 20–40 degrees. This promotes the generation of a cooling film on the interior surface of the wall and can avoid flow separation of the air entering the tube through the cooling holes. In one embodiment the angle of the holes with respect to the longitudinal axis is about 30 degrees.

In preferred embodiments, the holes are additionally angled with respect to the tube circumference, that is to say with respect to a line tangential to the tube at the positions of the respective holes on the tube circumference. In this way it is possible to induce a vortex flow of cooling air on the interior surface of the tube as the cooling air passes into the combustion chamber. This is particularly beneficial in terms of cooling the interior surface of the tube.

In preferred embodiments the holes have a tangential component substantially in the range of 30–60 degrees with respect to the tube circumference. By angling the holes with respect to the tube circumference by this amount it is possible to generate a steady vortex flow on the interior surface of the tube. In a preferred embodiment the angle of the holes with respect to the tube circumference is in the range of 40–50 degrees with respect to the tube circumference. In further preferred embodiment the angle is substantially about 45 degrees.

According to another aspect of the invention there is provided a Helmholtz resonator for a gas turbine engine combustion chamber; the said resonator having a resonator cavity and a damping tube for flow communication with the interior of the combustion chamber, the tube having at least one cooling hole extending through the wall thereof. The invention contemplates a Helmholtz resonator in which the damping tube comprises at least one cooling hole and also a combustion chamber including such a resonator.

According to another aspect of the invention there is provided a combustion chamber for a gas turbine engine comprising at least one Helmholtz resonator having a cavity and a damping tube in flow communication with the interior of the combustion chamber, the said at least one resonator being supported with respect to the combustion chamber independently of the combustion chamber. This aspect of the invention is particularly suitable for gas turbine aero engine applications where the combustion chamber is not a structural component as such, in the sense that it does not support structural loads of the engine, and is constructed as a relatively lightweight component. By supporting the resonator or resonators independently of the combustion chamber strengthening of the combustion chamber can be avoided. This aspect of the invention recognises that the resonator or resonators can be more readily supported by more appropriate structural components of the engine or engine combustion section.

According to a further aspect of the invention there is provided a gas turbine engine combustion section including a combustion chamber, a combustion chamber inner casing and a combustion chamber outer casing; the said combustion chamber comprising at least one Helmholtz resonator having a cavity and a damping tube in flow communication with the interior of the combustion chamber, the said at least one resonator being supported with respect to the combustion chamber independently of the combustion chamber by the said combustion chamber inner casing or the said outer casing. Supporting the resonator or resonators by the combustion chamber inner casing or outer casing of a gas turbine engine, it is possible that no significant strengthening of the combustion chamber, inner casing or outer casing is required. In this way it is possible to support both the weight and the operational loads, static and dynamic, using existing engine structural components in the region of the combustion chamber. The combustion chamber is not subject therefore to further loads and therefore may be of a similar weight and dimensions to that of traditional combustors.

In one preferred embodiment the resonator or resonators is/are supported by the outer casing with the resonator(s) positioned on the radially outer side of the combustion chamber. In other embodiments the resonator(s) is/are supported by the inner casing with the resonator(s) positioned on the radially inner side of the combustion chamber. The invention contemplates embodiments where the resonators are positioned on the radially outer side of the combustion chamber and conveniently supported by, or fixed to, the combustion chamber outer casing, and also embodiments where the resonators are on the radially inner side of the combustion chamber and supported both directly or indirectly by the combustion chamber inner casing. In other embodiments different resonators may be positioned on both the radially inner and outer sides of the combustion chamber. The invention therefore provides various options to the gas turbine engine designer when positioning the resonators. This may be an important design consideration due to space constraints in the combustion section of the gas turbine engine.

In embodiments where at least one resonator is supported by the inner casing and the resonator is positioned on the radially inner side of the combustion chamber, the resonator(s) may be enclosed within a cavity provided between the inner casing and a windage shield on a radially inner side of the inner casing.

The windage shield is a particularly important feature in embodiments where the resonators are positioned on the radially inner side of the combustion chamber as this can place the resonators close to the main engine shaft or shafts. The windage shield can therefore reduce windage losses which would otherwise occur due to the close proximity of the resonators to the engine shaft. The windage shield can also provide a containment structure to prevent secondary damage to the engine in the event of loss of structural integrity of any of the resonators secured to the combustion chamber inner casing.

According to a further aspect of the invention there is provided a gas turbine engine combustion section including a combustion chamber and at least a combustion chamber inner casing; the said combustion chamber comprising at least one Helmholtz resonator having a cavity and a damping tube in flow communication with the interior of the combustion chamber, the said at least one resonator being at least partially enclosed within a cavity provided between the said inner casing and a windage shield on a radially inner side of the said casing.

In preferred embodiments the resonators are enclosed within the cavity provided between the combustion chamber inner casing and the windage shield. Preferably the resonators are circumferentially spaced around the combustion chamber.

According to another aspect of the invention there is provided a combustion chamber for a gas turbine engine comprising a plurality of Helmholtz resonators each having a cavity and a damping tube in flow communication with the interior of the combustion chamber, the said resonators being circumferentially spaced around the combustion chamber with the respective cavities of diametrically opposed resonators having substantially different volumes. This is particularly significant since it can prevent or at least reduce the formation of coupled acoustic nodes in the combustion chamber. In preferred embodiments this can be achieved by positioning the resonators circumferentially around the combustion chamber with the cavities of the respective resonators having successively smaller volumes. In this way it will be understood that the cavity having the largest volume will be positioned next to the cavity having the smallest volume.

In a further aspect of the invention there is provided a combustion chamber for a gas turbine engine comprising at least one Helmholtz resonator having a resonator cavity and a damping tube in flow communication with the interior of the combustion chamber, the said cavity having substantially similar principle dimensions. For efficient performance, the three principle dimensions, ie length, breadth and width of the cavities should be substantially the same. This can be achieved in principle when the cavities have a substantially spherical or cubic shape.

In a further aspect of the invention there is provided a combustion chamber for a gas turbine engine of the type having a plurality of heat shield type tiles lining the interior surface of the combustion chamber; the combustion chamber comprising at least one Helmholtz resonator having a cavity and a damping tube in flow communication with the interior of the combustion chamber with the tube having an opening in the interior of the combustion chamber substantially flush with the interior surface of the tiled lining. In embodiments where the combustion chamber has a lining on its interior surface made up of heat resistant tiles it is desirable that the resonator tube or tubes extend into the combustion chamber so that the openings of the tube or the tubes in the interior of the chamber is/are substantially flush with the interior facing surfaces of the tiles.

For the avoidance of doubt the term "combustion chamber" used herein is used interchangeably with the term "combustor" and reference to one include reference to the other.

Various embodiments of the invention will now be more particularly described, by way of example only, with reference to the accompanying drawings in which.

Figure 1:
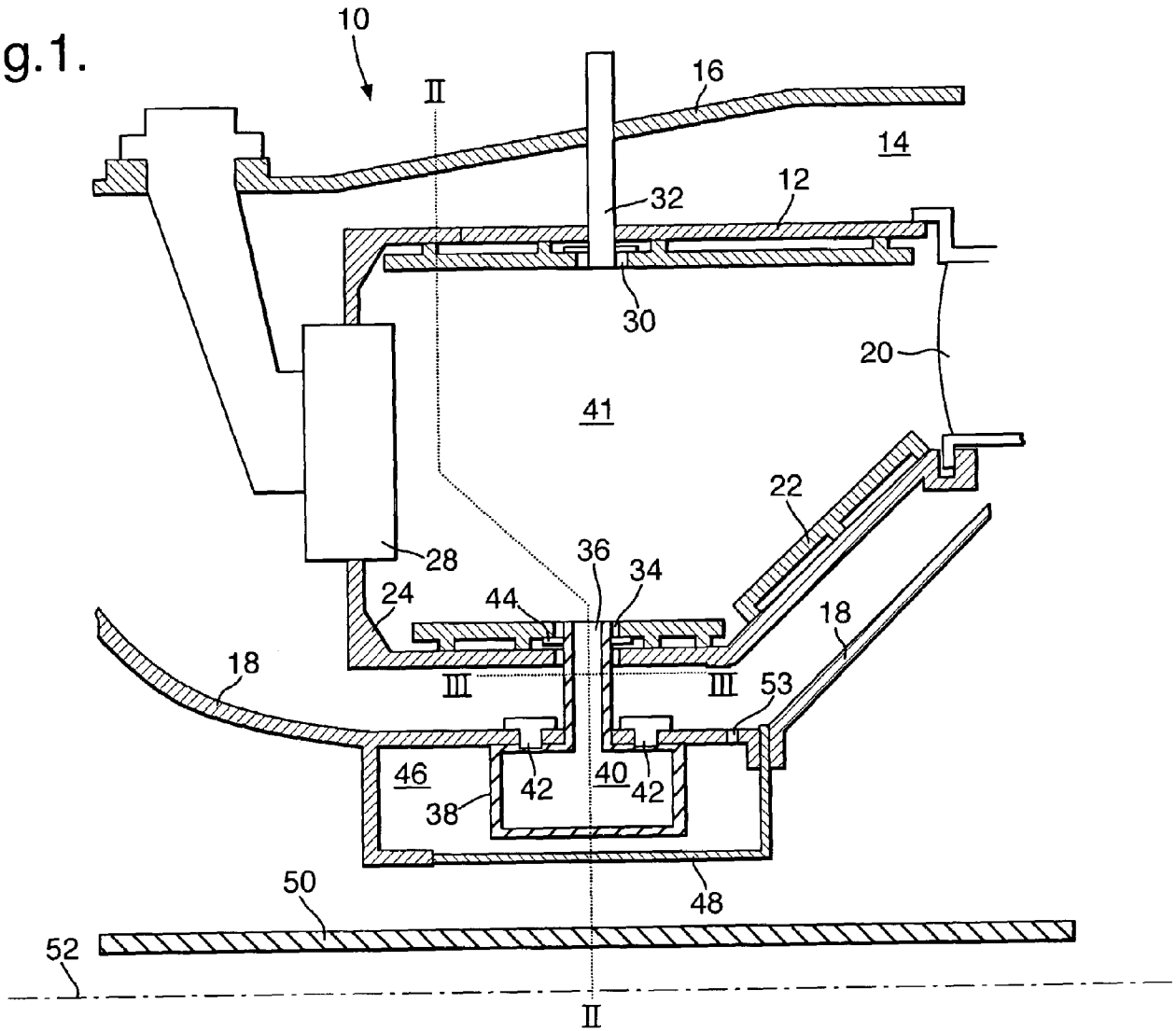
FIG. 1 is an axisymmetric view of a gas turbine engine combustion chamber showing a Helmholtz resonator in flow communication with the interior of the chamber.

Referring to FIG. 1, the combustion section 10 of a gas turbine aero engine is illustrated with the adjacent engine parts omitted for clarity, that is the compressor section upstream of the combustor (to the left of the drawing in FIG. 1) and the turbine section downstream of the combustion section. The combustion section comprises an annular type combustion chamber 12 positioned in an annular region 14 between a combustion chamber outer casing 16, which is part of the engine casing structure and radially outwards of the combustion chamber, and a combustion chamber inner casing 18, also part of the engine structure and positioned radially inwards of the combustion chamber 12. The inner casing 16 and outer casing 18 comprise part of the engine casing load bearing structure and the function of these components is well understood by those skilled in the art. The combustion chamber 12 is cantilevered at its downstream end from an annular array of nozzle guide vanes 20, one of which is shown in part in the drawing of FIG. 1. In this arrangement the combustion chamber may be considered to be a non load bearing component in the sense that it does not support any loads other than the loads acting upon it due to the pressure differential across the walls of the combustion chamber.

The combustion chamber comprises a continuous heat shield type lining on its radially inner and outer interior surfaces. The lining comprises a series of heat resistant tiles 22 which are attached to the interior surface of the radially inner and outer walls of the combustor in a known manner. The upstream end of the combustion chamber comprises an annular end wall 24 which includes a series of circumferentially spaced apertures 26 for receiving respective air fuel injection devices 28. The radially outer wall of the combustion chamber includes at least one opening 30 for receiving the end of an ignitor 32 which passes through a corresponding aperture in the outer casing 16 on which it is secured.

The radially inner wall of the combustion chamber is provided with a plurality of circumferentially spaced apertures 34 for receiving the end part of a Helmholtz resonator damping tube 36. Each Helmholtz resonator 38 comprises a box like resonator cavity 40 which is in flow communication with the interior of the combustion chamber through the damping tube 36 which extends radially from the resonator cavity 40 into the interior 41 of the combustor. In the drawing of FIG. 1 the resonator cavity 40 extends circumferentially around part of the circumference of the combustion chamber inner casing 18 on the radially inner side thereof. The damping tube 36 extends through a respective aperture in the inner casing 18 in register with the aperture 34 in the combustion chamber inner wall. In this embodiment the damping tube has a substantially circular cross section although tubes having cross sections other than circular may be used. The Helmholtz resonator 38 is fixed to the inner casing 18 by fixing means 42 in the form of bolts, studs or the like. The resonator 38 is therefore mounted and supported independently of the combustion chamber 12. An annular sealing member 44 is provided around the outer periphery of the tube to provide a gas tight seal between the tube and the opening 34. The tube provides for limited relative axial movement of the tube with respect to the combustion chamber so that substantially no load is transferred from the resonator tube to the combustion chamber during engine operation.

Figure 2:
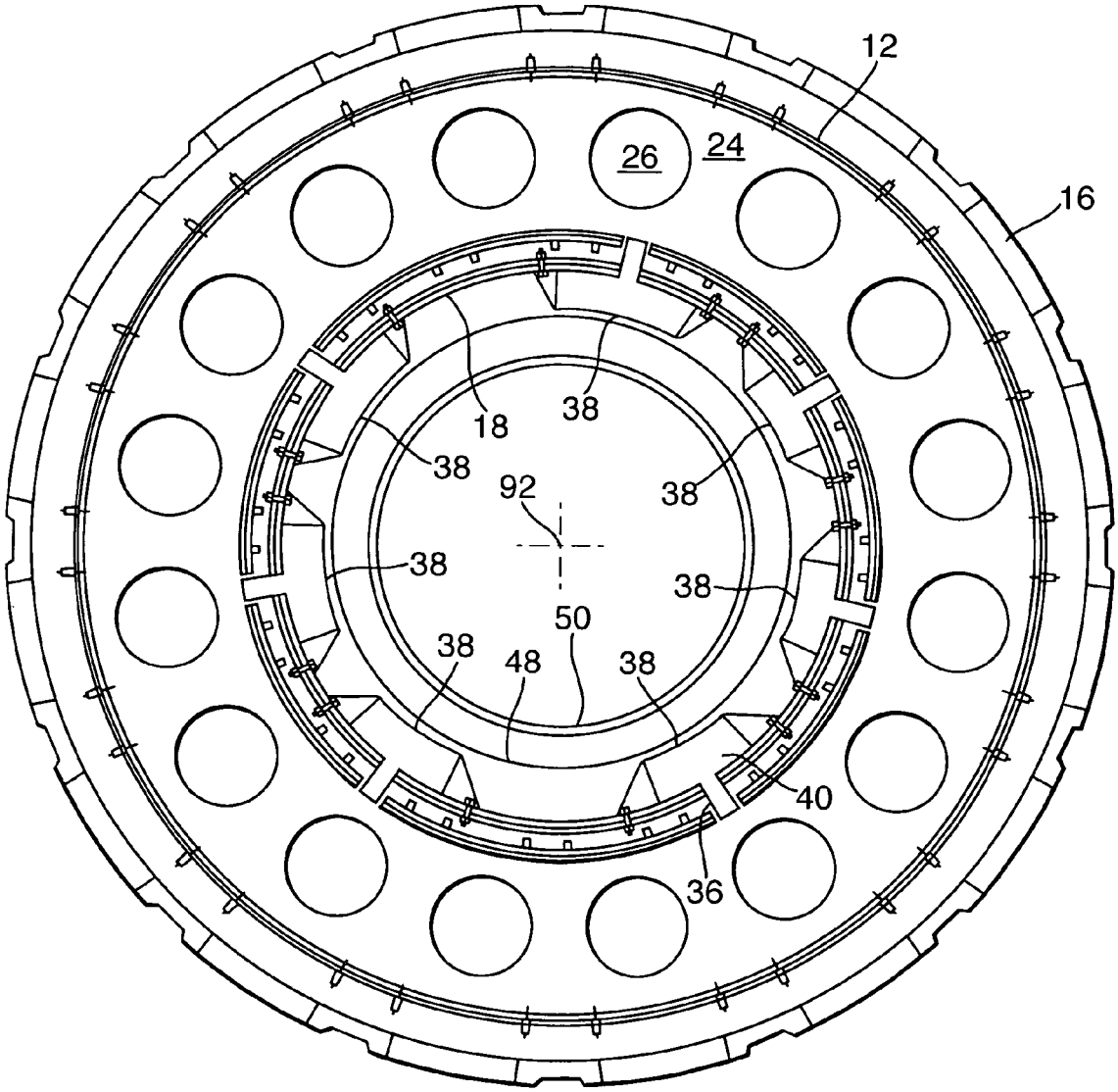
FIG. 2 is a cross sectional view of the gas turbine engine combustion section shown in FIG. 1 along the line II—II.

As can best be seen in the cross section drawing of FIG. 2, seven resonators 38 are positioned around the radially inner side of the combustion chamber inner casing 18. The resonators are arranged in two groups one including four resonators and the other group including the other three. The resonators have different circumferential dimensions such that the volume of the respective cavities 40 of the resonators is different for each resonator. This difference in cavity volume has the effect of ensuring each resonator has a different resonator frequency such that the respective resonators 38 compliment one another in the sense that collectively the resonators operate over a wide frequency band to damp pressure oscillations in the combustion chamber over substantially the entire running range of the engine. Each resonator has a particularly frequency and the resonator cavities 40 are sized such that the different resonator frequencies do not substantially overlap.

The resonator cavities are enclosed in an annular cavity 46 defined on one side by the combustion chamber inner casing 18 and along the other side by a windage shield 48, which, in use, functions to reduce windage losses between the box type resonators 38 and the high pressure engine shaft 50 when it rotates about the engine axis 52. The windage shield 48 extends annularly around the inner casing 18 to enclose all seven resonators 38 in a streamlined manner so that windage losses are not generated by the close proximity of the resonator cavities to the engine shaft 50. A further function of the windage shield. 48 is that it provides a containment structure in the event of mechanical failure of any one of the resonators 38. In the event of a mechanical failure resulting in the loss of structural integrity of a resonator, or other engine components, the windage shield acts to prevent the occurrence of secondary damage to the engine by contact with the engine shaft 50. Apertures 53 are provided in the combustion chamber inner casing 18 to allow flow communication between the annular region 14, and the annular cavity 46 defined by the windage shield 48 and the combustion chamber inner casing 18. This ensures that, during engine operation, the enclosed volume 46 of the windage shield is at the same pressure as the annular region 14 surrounding the combustion chamber, which is at higher pressure than the combustion chamber interior 41. The resultant pressure difference guarantees that, in the event of mechanical failure of any one of the resonators, air flows air into the combustion chamber 12 from the enclosed volume 46, preventing the escape of hot exhaust gasses that would severely hazard, for example, the engine shaft 50.

Figure 3:
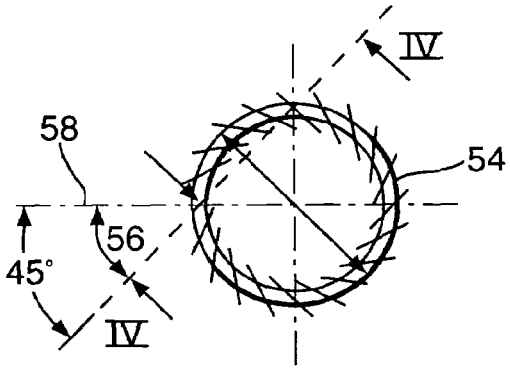
FIG. 3 is a cross section view of the damping tube of the resonator along the lines III—III in the drawing of FIG. 1.
Figure 4:
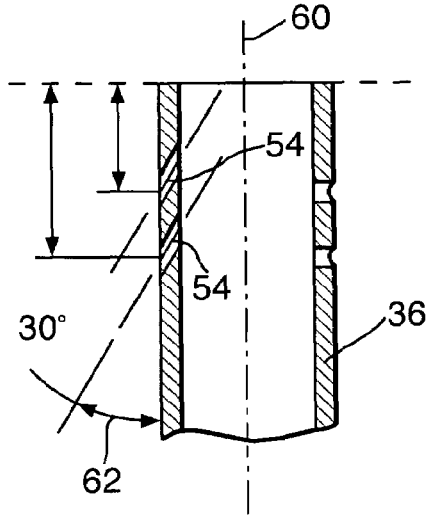
FIG. 4 is a cross section view of the damping tube shown in FIG. 3 along the line IV—IV in the drawing of FIG. 3.
Figure 5:
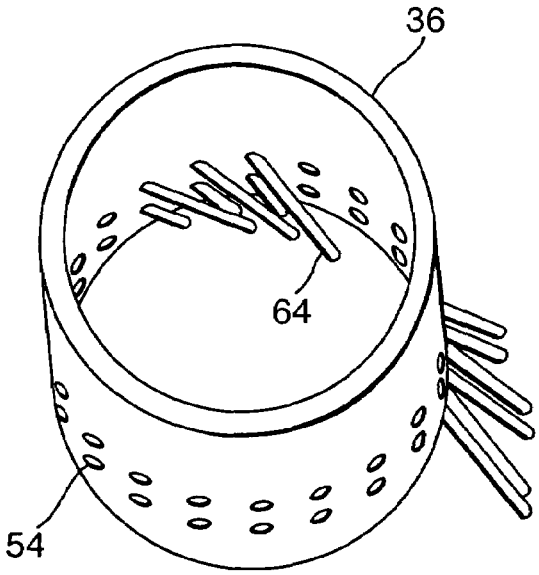
FIG. 5 is a perspective view of the damping tube showing the beam paths of a laser in a process of laser drilling cooling holes in the tube wall.

Referring now to FIGS. 3–5 which show various views of the damping tube 36 common to each of the resonators 38. As can be seen in FIG. 3, the tube has a circular cross section with a plurality of circumferentially spaced cooling holes 54 formed in the tube wall. The cooling holes 54 are equally spaced around the tube circumference and are inclined with respect to respective lines tangential to the tube circumference at the hole locations. As can be seen in the drawings of FIGS. 4 and 5 two rows of cooling holes are provided in axially spaced relation along the length of the tube. In one embodiment the tube comprises twenty 0.5 mm diameter holes in each row in a 16.0 mm diameter tube. The rows of cooling holes are preferably positioned towards the open end of the tube in the combustion chamber. For instance, the first row of holes may be positioned a quarter to a third of the way along the length of the tube from the combustion chamber end, with the second row approximately halfway along the tube.

As shown in FIG. 3, in the plane perpendicular to the longitudinal axis of the tube the cooling holes 54 are angled so that they have both a radial and tangential component with respect to the circumference of the tube. Each hole is inclined at angle 45 degrees, as indicated by angle 56 in the drawing of FIG. 3, with respect to the radial line 58 through the respective hole and the tube longitudinal axis. This promotes vortex flow on the interior surface of the tube when cooling air passes from the exterior region of the tube into the interior region thereof.

Referring now to FIG. 4, it can also be seen that the holes are angled with respect to the longitudinal axis 60 of the tube. In the illustrated embodiment the holes have an angle of 30 degrees, indicated by angle 62 in the drawing, and are inclined towards the combustion chamber end of the tube such that the respective axis of the holes converge towards the tube axis 60. The three dimensional nature of the inclination of the holes with respect to the wall of the tube is more clearly presented in FIG. 5 which shows the path of respective laser beams 64 passing through the holes and the open end of the tube during laser drilling of the holes. As the beams follow a substantially straight line the beams are indicative of the cooling hole axes.

Although aspects of the invention have been described with reference to the embodiments shown in the accompanying drawing, it is to be understood that the invention is not limited to those precise embodiments and that various changes and modifications may be effected without further inventive skill and effort. For example, other cooling hole configurations may be used including arrangements where the holes are arranged in several rows, in line, or staggered with respect to each other, with different diameters, number of holes and angles depending on the specific cooling requirements of the particular combustion chamber application. In addition, different shaped holes may be employed instead of substantially circular cross section holes. The drawings of FIGS. 1 and 2 show the resonators positioned on the radially inner side of the combustion chamber and mounted to the combustion chamber inner casing. In other embodiments the resonators may be located on the radially outer side of the combustion chamber and secured to the combustion chamber outer casing 16. In the latter arrangement a windage shield would not necessarily be required.

The invention claimed is:

1. A gas turbine engine combustion section, comprising an annular region defined by a combustion chamber inner casing and a combustion chamber outer casing;

a combustion chamber located in the annular region and comprising at least one Helmholtz resonator having a cavity and a damping tube in flow communication with the interior of the combustion chamber, wherein the damping tube extends into the interior of the combustion chamber, and the at least one Helmholtz resonator is supported independently of the combustion chamber by the combustion chamber inner casing, and the at least one Helmholtz resonator is supported by the combustion chamber inner casing with the at least one Helmholtz resonator positioned on the radially inner side of the combustion chamber and enclosed within a cavity provided between the combustion chamber inner casing and a windage shield on a radially inner side of the casing.

2. The combustion section as claimed in claim 1 wherein the at least one Helmholtz resonator comprises a plurality of Helmholtz resonators, and the combustion chamber comprises the plurality of Helmholtz resonators, each enclosed within the cavity provided by the windage shield.

3. The combustion section as claimed in claim 2 wherein the plurality of Helmholtz resonators is circumferentially spaced around the combustion chamber.

4. The combustion section as claimed in claim 1 wherein the combustion chamber comprises a plurality of Helmholtz resonators each having a cavity and a damping tube in flow communication with the interior of the combustion chamber, wherein the damping tube extends into the interior of the combustion chamber, and the plurality of Helmholtz resonators is spaced around an inner circumference of the combustion chamber with the respective cavities of diametrically opposed resonators having substantially different volumes.

5. The combustion section as claimed in claim 4 wherein the plurality of Helmholtz resonators is circumferentially spaced around the combustion chamber with the cavities of respective resonators having successively smaller volumes.

* * * * *